US007159732B2

(12) United States Patent
Smith et al.

(10) Patent No.: US 7,159,732 B2
(45) Date of Patent: Jan. 9, 2007

(54) RECLOSABLE CONTAINER LID

(75) Inventors: Stephen Alan Smith, Naperville, IL (US); Dawn Ellen Huston, Linderhurst, IL (US); Warren Giles Wiedmeyer, Trevor, WI (US); Stephen William Sullivan, Round Lake Beach, IL (US); Rich Matthew Chin, Lincolnwood, IL (US); Mohammed Maqsood Ahmed, Niles, IL (US); John Stewart Gitschlag, Chicago, IL (US); David Raymond Langelan, Oak Park, IL (US); Rajendra Ranjitbhai Chauhan, Skokie, IL (US); William Edward Hurst, Lisle, IL (US); James Tam Joines, Jr., Gurnee, IL (US); Kevin Ray Smith, Round Lake Beach, IL (US); Mark Gerald Anhalt, Franklin, WI (US); Bryce G. Rutter, St. Louis, MO (US); Brian C. Bone, St. Louis, MO (US); Heath A. Doty, Richmond Heights, MO (US)

(73) Assignee: Solo Cup Operating Corporation, Highland Park, IL (US)

( * ) Notice: Subject to any disclaimer, the term of this patent is extended or adjusted under 35 U.S.C. 154(b) by 327 days.

(21) Appl. No.: 10/645,268

(22) Filed: Aug. 21, 2003

(65) Prior Publication Data

US 2004/0035868 A1 Feb. 26, 2004

Related U.S. Application Data

(62) Division of application No. 09/923,763, filed on Aug. 6, 2001, now Pat. No. 6,732,875.

(51) Int. Cl.

| | |
|---|---|
| ***B65D 51/18*** | (2006.01) |
| ***B65D 43/18*** | (2006.01) |
| ***A47G 19/22*** | (2006.01) |

(52) U.S. Cl. ..... 220/253; 220/713; 220/254.4; 220/711; 220/715

(58) Field of Classification Search ..... 220/259.1, 220/711–719, 256.1, 731, 254.4, 254.1, 253, 220/254.3, 254.7, 254.8, 254.9, 255; 222/555, 222/548; 229/404, 906.1

See application file for complete search history.

(56) References Cited

U.S. PATENT DOCUMENTS 1,237,228 A 8/1917 Westover (Continued)

FOREIGN PATENT DOCUMENTS

CH 393 955 11/1965

(Continued)

OTHER PUBLICATIONS

*Copy of photograph of HotJo Ceramic Mug/Lid obtained through market research, Apr. 2000.

(Continued)

*Primary Examiner*—Robin Hylton
(74) *Attorney, Agent, or Firm*—Banner & Witcoff, Ltd.

(57) ABSTRACT

A reclosable lid 10 for a container holding a flowable substance has a first piece or cover 12, and a movable second piece or disk 50. The cover 10 has a top wall 14, a side wall 16 and a mounting portion 22 for connecting the lid 10 on the container. The cover 12 has an opening 28 adapted to permit the flow of the substance through the lid 10. The cover 12 further includes a slot 30 located in the top wall 14. The disk 50 has at least one aperture 78, a post 54, and a projection 52. The aperture 78 and the projection 52 are each cooperatively dimensioned with the opening 28. The post 54 is adapted to be received by the slot 30 in the cover 12. The disk 50 is movable between a first position wherein at least a portion of the projection 52 is received in the opening 28 in the first position, and a second position wherein the aperture 78 is aligned with the opening 28 in the second position. A support ledge 102 and a support edge 104 on an inner surface 100 of the cover 12 are adapted to provide rotatable support to the disk 50.

25 Claims, 4 Drawing Sheets

U.S. PATENT DOCUMENTS 1,725,393 A 8/1929 Cone
1,752,720 A 4/1930 Bergelson
1,896,976 A 8/1933 Schifferdecker
2,121,554 A 6/1938 Thorn
2,495,806 A 1/1950 Block
2,554,710 A 5/1951 Leccese
3,031,111 A 4/1962 Stull
3,083,861 A 4/1963 Amberg et al.
3,188,036 A 6/1965 Spurng
3,193,130 A 7/1965 Miller
3,261,516 A * 7/1966 Allen ..... 222/548
3,262,612 A 7/1966 Tabor
3,326,401 A 6/1967 De Long
3,327,905 A 6/1967 Gould
3,459,324 A 8/1969 Miller
3,690,514 A 9/1972 Wilson
3,805,991 A 4/1974 Cheladze et al.
3,874,580 A 4/1975 Weatherhead, III
3,994,411 A 11/1976 Elfelt et al.
4,091,956 A 5/1978 Vecchio
4,138,033 A 2/1979 Payne et al.
4,141,461 A 2/1979 LaChance
4,183,443 A 1/1980 DeParales et al.
4,188,457 A 2/1980 Throp
4,203,527 A 5/1980 LaChance, Sr.
4,253,582 A 3/1981 Shields
4,331,255 A 5/1982 Fournier
4,333,583 A 6/1982 Montemarano
4,345,695 A 8/1982 Galloway et al.
4,347,946 A 9/1982 Nichols
4,350,260 A 9/1982 Prueher
4,361,249 A 11/1982 Tuneski et al.
4,420,092 A 12/1983 Finkelstein
4,441,624 A 4/1984 Sokolowski
4,449,640 A 5/1984 Finkelstein
4,460,103 A 7/1984 Rama et al.
4,478,346 A 10/1984 Spong
4,503,992 A 3/1985 Sitko et al.
4,557,398 A 12/1985 Hambleton et al.
4,570,817 A 2/1986 Hambleton et al.
4,579,245 A 4/1986 Narushko
4,589,569 A 5/1986 Clements
4,598,837 A 7/1986 Kreiseder et al.
4,615,459 A 10/1986 Clements
4,619,372 A 10/1986 McFarland
4,629,088 A 12/1986 Durgin
4,657,139 A 4/1987 Hanifl
4,703,873 A 11/1987 Geren
4,705,197 A 11/1987 Gordon et al.
4,712,704 A * 12/1987 Ramsey et al. ..... 220/254.4
4,718,570 A 1/1988 Diener
4,738,373 A 4/1988 DeParales
4,741,450 A 5/1988 Braude
4,747,511 A 5/1988 Dutt et al.
4,753,365 A 6/1988 Seppala
4,770,325 A 9/1988 Gordon et al.
4,782,975 A 11/1988 Coy
4,790,444 A 12/1988 Terzi
4,792,054 A 12/1988 Weidman
4,796,774 A 1/1989 Nabinger
4,863,051 A 9/1989 Eibner et al.
4,869,389 A 9/1989 Cerrone, Jr.
4,874,103 A 10/1989 Quisenberry et al.
4,898,295 A 2/1990 Kim
4,899,902 A 2/1990 DeMars
4,915,250 A 4/1990 Hayes, Jr.
4,930,654 A 6/1990 Thibeault et al.
4,932,555 A 6/1990 La Barge
4,938,379 A 7/1990 Kellner
4,949,865 A 8/1990 Turner
4,953,743 A 9/1990 Dart et al.
4,966,300 A 10/1990 Coonradt
5,012,061 A 4/1991 Lesser
5,058,778 A * 10/1991 Weinstein ..... 222/209
5,072,849 A * 12/1991 Blau ..... 220/253
5,090,584 A 2/1992 Roberts et al.
5,111,961 A 5/1992 Van Melle
5,148,936 A 9/1992 DeGrow
5,167,338 A 12/1992 Kick
5,180,073 A 1/1993 Fay et al.
5,183,172 A 2/1993 Boller
5,193,704 A 3/1993 Kick
5,197,624 A 3/1993 Doddaro
5,205,430 A 4/1993 Valyi
5,294,014 A 3/1994 Wyatt et al.
D346,718 S 5/1994 Timmermans
5,395,006 A 3/1995 Verma
5,398,843 A 3/1995 Warden et al.
5,415,312 A 5/1995 Mueller
5,421,472 A 6/1995 Beckertgis
5,449,085 A 9/1995 Brun, Jr.
5,485,938 A 1/1996 Boersma
5,490,609 A 2/1996 Lane et al.
5,495,941 A 3/1996 Leonard
5,497,920 A 3/1996 Moeller et al.
D368,624 S 4/1996 Forrer
5,503,289 A 4/1996 Fox
5,503,662 A 4/1996 Berger
5,588,561 A 12/1996 Ness
5,613,619 A 3/1997 Van Melle
5,699,927 A 12/1997 Lane et al.
5,706,972 A 1/1998 Sousa
5,718,353 A 2/1998 Kanfer et al.
5,727,707 A 3/1998 Wickland et al.
5,766,660 A 6/1998 Lee et al.
5,775,205 A 7/1998 Melton
5,839,601 A 11/1998 Van Melle
D402,556 S 12/1998 Frye
5,866,184 A 2/1999 Gorlich et al.
5,873,298 A 2/1999 Chang
5,911,331 A 6/1999 Boller
5,913,964 A 6/1999 Melton
5,947,319 A 9/1999 Sinski
5,947,323 A 9/1999 Freek et al.
5,954,241 A 9/1999 Huang
5,979,689 A 11/1999 Lansky
5,984,127 A 11/1999 Fenton
5,996,837 A 12/1999 Freek et al.
6,003,711 A 12/1999 Bilewitz
6,010,029 A 1/2000 Wang
6,089,397 A 7/2000 Van Melle
6,095,033 A 8/2000 Melton
6,176,384 B1 1/2001 Voloshin
D437,223 S 2/2001 Coy et al.
6,199,711 B1 3/2001 Lansky
6,216,904 B1 4/2001 Cagan
6,220,470 B1 4/2001 McHenry et al.
6,305,571 B1 10/2001 Chu
6,374,726 B1 4/2002 Melton
6,419,105 B1 7/2002 Bruce et al.
6,578,726 B1 6/2003 Schaefer
6,612,456 B1 9/2003 Hundley et al.
D480,968 S 10/2003 Atkins et al.
6,644,490 B1 11/2003 Clarke
6,757,957 B1 * 7/2004 McClean et al. ..... 29/453
2002/0027139 A1 3/2002 O'Neill
2003/0089713 A1 5/2003 Belt et al.
2003/0089714 A1 5/2003 Dart et al.
2003/0141302 A1 7/2003 Ryan et al.

FOREIGN PATENT DOCUMENTS

DE 18 16 709 A 2/1970
DE 295 02 654 U1 8/1995

| | | | | |
|---|---|---|---|---|
| EP | 0 160 372 | A | | 11/1985 |
| EP | 0 383 442 | A1 | | 8/1990 |
| GB | 1 576 123 | A | | 10/1980 |
| GB | 2055773 | A | * | 3/1981 |
| GB | 1 600 917 | | | 10/1981 |
| GB | 2 091 232 | A | | 7/1982 |
| GB | 2 182 027 | A | | 5/1987 |
| JP | 07-309379 | | | 11/1995 |
| JP | 10-129706 | A | | 5/1998 |
| JP | 2000-159254 | | | 6/2000 |
| WO | WO 99 47429 | | | 9/1999 |
| WO | WO 00 51908 | | | 9/2000 |

OTHER PUBLICATIONS

*Copy of photograph of Starbucks Cup/Lid obtained through market research, Apr. 2000.

*Copy of photograph of Super America Cup/Lid obtained through market research, Apr. 2000.

*Copy of photograph of Dunkin Donuts Cup/Lid obtained through market research, Apr. 2000.

*Berrington, N., *International Search Report*, Sep. 4, 2002, 6 pp., Patent Cooperation Treaty, Rijswijk, Netherlands.

*Seven (7) color photgraphs showing different views of Whirley Thermo Mug/Lid obtained in Feb. 2003.

US 6,003,721, 12/1999, Fleming (withdrawn)

* cited by examiner

RECLOSABLE CONTAINER LID

CROSS-REFERENCE TO RELATED APPLICATIONS

This is a divisional application of U.S. patent application Ser. No. 09/923,763, filed Aug. 6, 2001, which issued on May 11, 2004 as U.S. Pat. No. 6,732,875.

FEDERALLY SPONSORED RESEARCH OR DEVELOPMENT

Not Applicable.

TECHNICAL FIELD

The present invention relates to a lid for a flowable substance container. More specifically, the present invention relates to a reclosable lid for use with a drink container.

BACKGROUND OF THE INVENTION

Lids for containers are well-known in the beverage container industry. In general terms, lids for single-use or disposable containers have three main components: a top wall or surface, a mounting portion, and an opening. Typically, the mounting portion is adapted to engage an upper rim of the container to seal the lid on the container. The opening is adapted to permit the flow of the container contents through the lid.

Existing lid designs suffer from a number of problems including untimely spillage through the opening due to the lack of a reliable means for sealing the opening. The inability to effectively seal the opening can also result in a significant loss of heat from the container contents through the opening. To address these and other problems, a number of lid designs include a movable cover portion for the opening. However, most existing movable covers lack structural integrity and as a result, do not effectively seal the opening. Also, a number of movable covers are difficult to operate due to their complex design. In addition, a vast majority of movable covers interfere with a user consuming the container contents through the opening.

U.S. Pat. No. 4,579,245 to Narushko provides an example of a container lid with a movable closing flap. The lid has a raised segment that forms a channel, which is adapted to receive the closing flap. The closing flap is a curved piece that must be inserted into the channel. The closing flap is movable between an open position and a closed position. Because the movement of the closing flap is controlled by a series of notches, grooves, tabs and handles located on the channel and the closing flap, the closing flap is difficult to operate and the effectiveness of the lid is compromised.

Another example of a lid having a movable cover for the opening is disclosed in U.S. Pat. No. 4,790,444 to Terzi. There, the hood or lid has an opening formed from a depending spout that is inserted into the container opening. The cover has exterior dimensions equivalent to the lid and is placed over the lid. The cover has an opening that must be aligned with the spout and the lid opening to form the drink passageway. The cover has a plurality of sockets, which when properly aligned, seal the lid opening. The cover is supported on the lid by a series of intricate structures and an annular gasket. Due to its complex array of structures, the lid and cover are difficult to assemble and operate. Furthermore, the array of structures can inhibit the alignment of the lid opening and the cover opening negatively affecting the formation of the drink passageway.

Therefore, there is a definite need for a reclosable container lid that reliably seals the opening. In addition, there is a need for such a lid that is easy to operate and does not interfere with a user consuming the container contents through the opening.

The present invention is provided to solve these and other problems.

SUMMARY OF THE INVENTION

The present invention relates to a reclosable lid for use with a flowable substance container. The lid has a first piece or cover, and a reclosable second piece or disk. The cover has a top wall and a side wall depending from the top wall. The side wall has a mounting portion for connecting the lid on the container. The cover includes an opening in the top wall, the opening adapted to permit the flow of the substance through the lid. The cover further includes a slot located in the top wall and a recessed portion located in both the top wall and the side wall.

The disk has at least one aperture, a post, and a projection. The aperture and the projection are each cooperatively dimensioned with the opening. The aperture is adapted to form a passageway when aligned with the opening. The post is adapted to be received by the slot in the cover. The disk is movable between a first and second position, wherein at least a portion of the projection is received in the opening in the first position and the wherein the aperture is aligned with the opening in the second position. The disk has at least one well adapted to facilitate stacking the lids in a vertical configuration.

The cover includes at least one support member having a cavity extending radially inward from the side wall. The cavity of the support member forms a support ledge on an inner surface of the cover that is adapted to provide rotatable support to the disk. The disk is further supported by an internal edge that is formed on the inner surface by the recessed portion, which extends radially inward from the side wall.

The disk is movable between the first and second positions by a user engaging and actuating the post. While the disk is moved between the first and second positions, the disk is rotatably supported by the support ledge and the support edge.

In another preferred embodiment of the invention, the lid includes a cover and an overlay. The cover has a top wall and a side wall depending from the top wall. The side wall has a mounting portion for connecting the lid on the container. The lid includes an opening in the top wall, the opening adapted to permit the flow of the substance through the lid. The lid further includes a recessed portion located in both the top wall and the side wall.

The overlay has a top wall and a side wall depending from the top wall. The side wall has a mounting portion adapted to connect the overlay to the cover. Also, the overlay has a projection in the top wall and at least one aperture. In addition, the overlay has at least one gripping element adapted to facilitate rotational movement of the overlay.

The overlay and the disk are cooperatively dimensioned such that they are in rotational engagement when the overlay is positioned on the disk. The overlay is movable between a first position and a second position, wherein a portion of the projection is received in the opening in the first position and wherein the aperture is aligned with the opening in the overlay in the second position.

The overlay is movable between the first and second positions by a user engaging either the overlay or the gripping element. While the overlay is moved between the first and second positions, the overlay is rotatably supported by the engagement of the mounting portion of the cover and the mounting portion of the overlay.

Other features and advantages of the invention will be apparent from the following specification taken in conjunction with the following drawings.

DETAILED DESCRIPTION OF THE INVENTION

Figure 1:
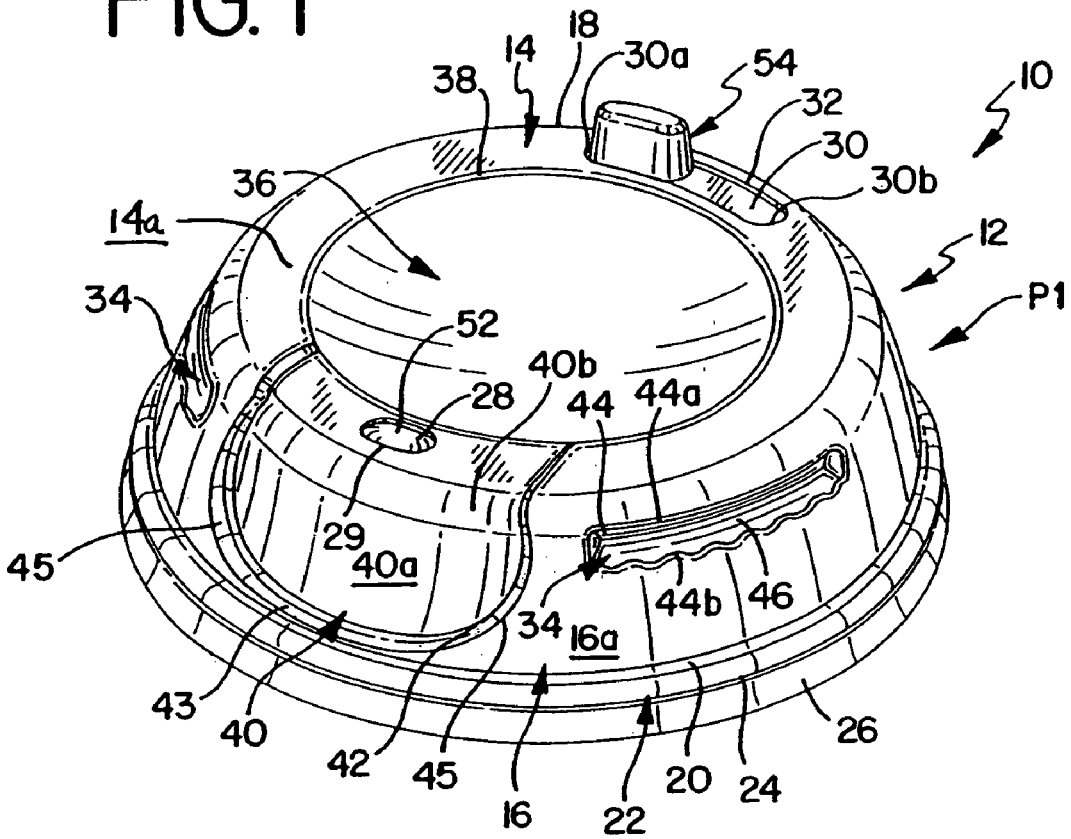
FIG. 1 is a perspective view of a reclosable lid of the present invention, showing a cover.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

A reclosable lid 10 for a container (not shown) of the present invention is illustrated in FIG. 1. The container has a central opening defining a volume that can be used to hold or contain a flowable substance, for example a liquid or a powder. The container and the lid 10 can be of either the disposable or extended use variety. FIG. 1 shows the lid 10 in the closed position wherein the lid 10 is sealed such that the flowable substance cannot flow through the lid 10. The lid 10 generally has a first piece or cover 12, and a movable second piece or disk 50 (positioned underneath cover 12 in FIG. 1).

The cover 12 of the lid 10 is adapted to span the opening in the upper portion of the container that is generally defined by an upper rim or edge of the container. For illustrative purposes, the container could be a coffee cup having an opening defined by the rim of the cup.

The cover 12 has an annular top wall 14 and a side wall 16 depending from a peripheral edge 18 of the top wall 14. Although the top wall 14 is shown as having a generally flat upper surface 14*a*, the upper surface 14*a* can be curved or angled. The side wall 16 has a side wall surface 16*a* and a lower edge 20. The side wall surface 16*a* can be curved or generally flat. The overall shape of the cover 12 is generally frustaconical, however, the cover 12 can have a number of other configurations.

A mounting portion 22 depends from the lower edge 20 of the side wall 16. The mounting portion 22 includes a generally annular flange 24 and a generally annular skirt 26. The mounting portion 22 is adapted for connecting the lid 10 to the container in a manner that seals the lid 10 on the container. Thus, the mounting portion 22 prevents leakage of the container contents between the lid 10 and the container when the lid 10 is positioned on the container. In a preferred embodiment, the mounting portion 22 is integral with the side wall 16.

An aperture or drink opening 28 is located preferably in the top wall 14. Alternatively, the drink opening is located in the side wall 16. The opening 28 is adapted to permit the passage or flow of the flowable contents held by the container through the cover 12. The opening 28 has an edge 29 that defines the shape of the opening 28. Although shown in FIG. 1 as having an obround shape, the opening 28 can have a variety of shapes, including but not limited to circular, square, or rectangular. In the closed lid position shown in FIG. 1, at least a portion of a projection 52 of the disk 50 is received by or positioned in the opening 28. Alternatively, the disk 50 has a generally planar surface that is aligned with a surface of the cover 12 proximate the opening 28 in a surface-to-surface engagement such that the opening 28 is sealed. These aspects will be described below in greater detail.

A slot or channel 30 is located preferably in the top wall 14. The slot 30 has an edge 32 that defines the shape of the slot 30. Although shown in FIG. 1 as having an obround shape, the slot 30 can have a variety of shapes, including but not limited to circular, square, or rectangular. A post 54 extends from the movable disk 50. The slot 30 is adapted to receive at least a portion of the post 54 extending through at least a portion of the slot 30. Described in a different manner, at least a portion of the post 54 extends past the top wall surface 14*a*. This aspect will also be described below in greater detail.

Figure 2:
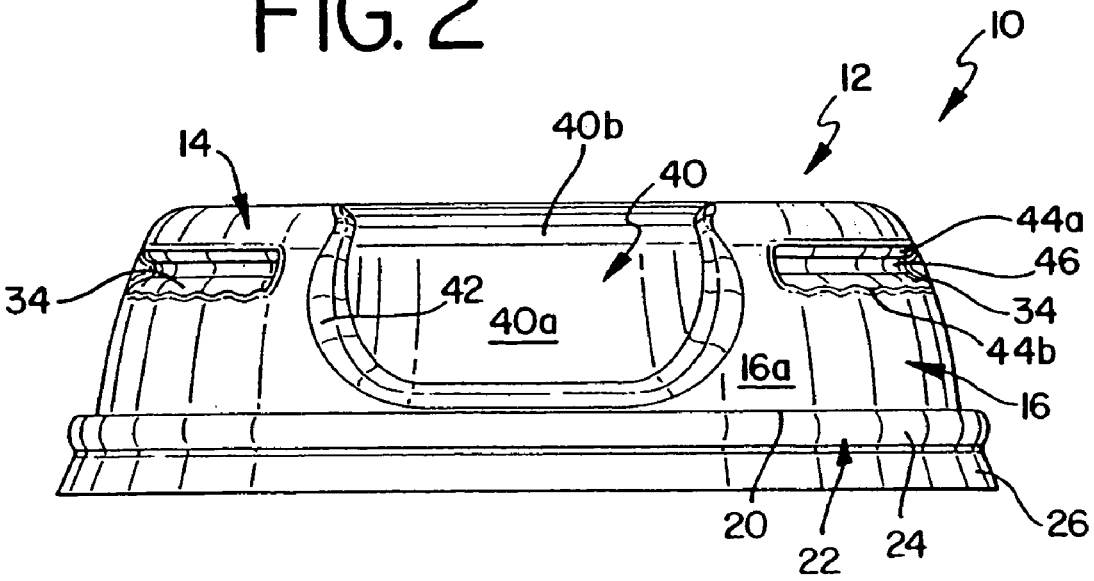
FIG. 2 is an end view of the cover of FIG. 1.

Referring to FIGS. 1 and 2, the cover 12 further comprises at least one support member 34. The support member 34 has a peripheral edge 44 that defines the shape of the support member 34. The peripheral edge 44 has an upper edge 44*a* and a lower edge 44*b*. The peripheral edge 44 can have a variety of shapes, including the linear shape of the upper edge 44*a* and the serrated shape of the lower edge 44*b*. A cavity 46 is recessed from the peripheral edge 44. Described in a different manner, the cavity 46 extends radially inward from the peripheral edge 44. As a result, at least a portion of the support member 34 extends radially inward past an inner surface of the side wall 16. The dimensions and configurations of the support member 34 and the cavity 46 can vary with design parameters, including but not limited to the overall size of the cover 12 and/or the size of the movable second piece 50. The position of the support member 34 can also vary along the height of the side wall 16. For example, the support member 34 can be positioned proximate the peripheral edge 18, or the support member 34 can be positioned closer to the mounting portion 22.

Figure 3:
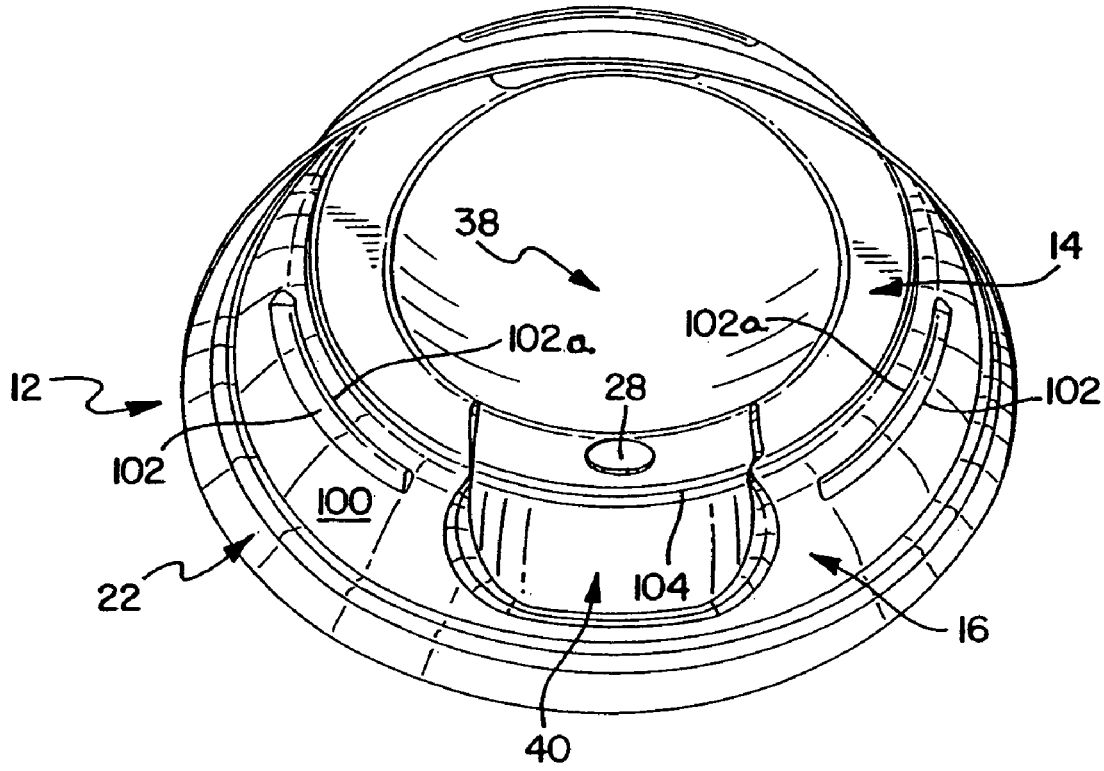
FIG. 3 is a perspective view of an interior cavity of the cover of FIG. 1.

FIG. 3 shows an interior cavity of the lid 12. At least one internal support ledge 102 is positioned on an internal surface 100 of the cover 12. The support ledge 102 is formed from the material defining the cavity 46 of the support member 34 which extends radially inward from the side wall 16. Accordingly, the material that forms the cavity 46 also forms the internal support ledge 102. The support ledge 102 has an upper edge 102*a*. Although shown having an elongated configuration, the dimensions and configurations of the support ledge 102 can vary depending upon the configuration of the support member 34 and the degree to which the support member 34 extends radially inward. The role of the support ledge 102 is fully described below.

As shown in FIG. 1, a center portion 36 is positioned radially inward from an inner edge 38 of the top wall 14. Preferably, the center portion 36 is recessed such that the center portion 36 has a curvilinear configuration when viewed in cross-section. The degree of recess or curvature of the center portion 36 can vary with the design parameters of the lid 10. Alternatively, the center portion 36 is in planar alignment with the top wall 14. In this configuration, the center portion 36 is not recessed.

Referring to FIGS. 1 and 2, the side wall 16 has a recessed portion 40, that is adapted to receive a lip of a person drinking from the container. An edge 42 of recessed portion 40 defines the configuration of the portion 40. In a preferred embodiment, the edge 42 has a generally straight base portion 43 that connects with a generally outwardly curved end segment 45 at each end. The recessed portion 40 is positioned radially inward from the side wall surface 16*a*. Although the recessed portion 40 is shown positioned on both the top wall 14 and the side wall 16, the recessed portion 40 can be limited to either the top wall 14 or the side wall 16. The shape and configuration of the recessed portion 40 can be varied to conform to numerous design parameters. Similarly, the degree of recess of the portion 40 can vary. For example, as shown in FIG. 1, the recessed portion 40 is deeper at base portion 43 and shallower at an end proximate the drink opening 28. Preferably, the recessed portion 40 is positioned about the drink opening 28. The top wall 14 and the side wall 16 cooperate to form a rounded edge 40*b* at the recessed portion 40.

Referring to FIG. 3, an internal support edge 104 is positioned in the internal surface 100 of the cover 12. The internal support edge 104 is formed from the material defining the recessed portion 40 which extends radially inward from the side wall 16. Accordingly, a portion of the material that forms the recessed portion 40 also forms the internal support edge 104. Preferably, the support edge 104 is positioned internal to and coincident with the rounded edge 40*b* of the recessed portion 40. The dimensions and configurations of the support edge 104 can vary depending upon the configuration of the recessed portion 40 and the degree to which the recessed portion 40 extends radially inward. The role of the support edge 104 is fully described below.

Figure 4:
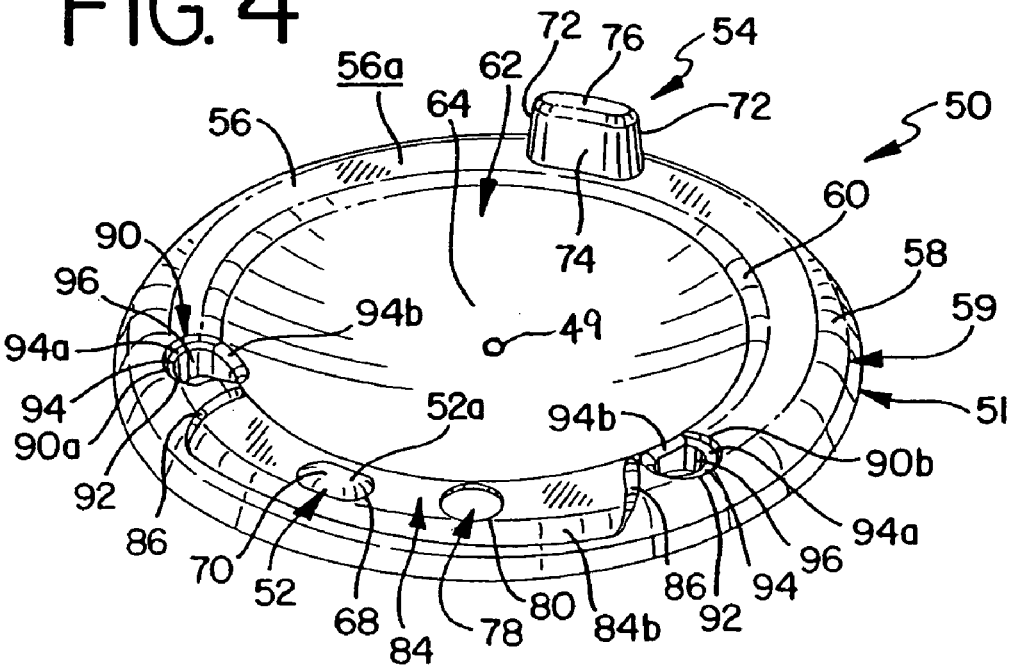
FIG. 4 is a perspective view of a movable disk of the lid of FIG. 1.

FIG. 4 shows the second piece or disk 50. The disk 50 has an outer edge 51 and a top wall 56 with a top wall surface 56*a*. The top wall 56 has an outer shoulder 58 and an inner shoulder 60. A side wall 59 depends from the outer shoulder 58. A center portion 62 extends radially inward from the inner shoulder 60. The center portion 62 comprises an annular side wall 64 and an inner portion 66. Preferably, the center portion 62 is recessed such that the center portion 62 has a curvilinear configuration when viewed in cross-section. The degree of recess or curvature of the center portion 62 can vary with the design parameters of the lid 10. Preferably, the degree of recess of the center portion 62 of the disk 50 is similar to the degree of recess of the center portion 36 of the cover 12. Alternatively, the inner portion 66 can be removed from the center portion 62 to reduce the weight and/or cost of the disk 50. In this configuration, the disk 50 has a ring-shaped configuration.

The projection 52 extends from a portion of the top wall 56. The projection 52 has a peripheral edge 68 that defines the shape of the projection 52. Preferably, the projection 52 is cooperatively dimensioned with the drink opening 28 such that at least a portion of the projection 52 is adapted to be received by or positioned in the opening 28. The projection 52 has a projection surface 52*a* that is preferably sloped or angled to facilitate reception of the projection 52 by the opening 28. When the projection 52 is completely received in the opening 28, the opening 28 is sealed and the lid 10 is in the closed position shown in FIG. 1. In the closed position, a top portion 70 of the projection 52 extends past the recessed portion surface 40*a*.

The post 54 extends from a portion of the top wall 56. As shown in FIG. 3, the post 54 has opposed end walls 72, opposed side walls 74, and a top wall 76. The post 54 can have either a solid or hollow construction depending upon design parameters. At least a portion of the post 54 is received by the slot 30 and extends past the top wall surface 14*a*. Although the configuration and dimensions of the post 54 can vary according to design parameters of the lid 10, the post 54 must retain a configuration that permits it to be received by the slot 30. As shown in FIG. 4, the post 54 has a catenoid shape. The post 54 can have a gripping portion (not shown) that is adapted to facilitate the engagement of a user's fingers with the post 54. The gripping portion can be integral to the post 54 or it can be a separate element fastened to a portion of the post 54. For example, the gripping portion can be a plastic or rubber element fastened to the walls 72, 74.

As shown in FIG. 4, the disk 50 has at least one aperture 78. The aperture 78 has a peripheral edge 80 that defines the shape of the aperture 78. When the aperture 78 is aligned with the drink opening 28, a passageway is formed between the disk 50 and the cover 12 permitting the passage or flow of the flowable substance held by the container through the lid 10. Although the aperture 78 can have a variety of configurations and dimensions, the aperture 78 is preferably cooperatively dimensioned with the drink opening 28. In a preferred embodiment, the aperture 78 is positioned within the disk 50 recessed portion 84 and spaced a distance from the projection 52. In another preferred embodiment, the disk 50 includes two separate apertures 78.

The disk recessed portion 84 is preferably positioned about the projection 52 and the aperture 78. The degree of recess of the portion 84 can vary. An edge 86 of recessed portion 84 defines the configuration of the recessed portion 84. Although the recessed portion 84 is shown positioned on a portion of both the disk side wall 59 and the disk top wall 56, the recessed portion 84 can be limited to either the side wall 59 or the top wall 56. The recessed portion 84 is adapted to be received by an inner surface of the recessed portion 40 of the cover 12 when the disk 50 is positioned proximate the cover 12. Accordingly, the shape and configuration of the recessed portion 84 of the disk 50 is similar to the shape and configuration recessed portion 40 of the cover 12. The top wall 56 and the side wall 59 cooperate to form a rounded edge 84*b* at the recessed portion 84.

As further shown in FIG. 4, the disk 50 has at least one well 90 depending from a portion of the disk 50. The disk 50 has a first well 90*a* and a second well 90*b* in one preferred embodiment. The well 90 can depend from either the top wall 56 or the side wall 59, or therebetween. The well 90 has an outer edge 92 that defines the general shape of the well 90. A shoulder 94 depends from the outer edge 92. The shoulder 94 can have a curvilinear portion 94*a* and a generally linear portion 94*b*. An inner wall 96 depends from the shoulder 94. As shown in FIG. 4, the inner wall 96 has a generally annular configuration resulting in a generally tubular well configuration. However, the well 90 can have a variety of configurations depending upon design parameters. Preferably, the well 90 has a bottom wall (not shown). Alternatively, the bottom wall is omitted, causing the well 90 to have a hollow, tubular configuration.

The first and second wells 90*a*, 90*b* can be positioned at various locations in the disk 50. Preferably, the first and second wells 90*a*, 90*b* are spaced a distance apart. The first well 90*a* and the second well 90*b* have the same dimensions and configurations. The depth or length of the well 90, as measured from a lower surface (not shown) of the disk 50 can vary. Similarly, the number and dimensions of the well 90, including the diameter, can vary with the numerous design parameters.

A drain hole 49 can be positioned in the disk 50, preferably in the center portion 62. When the flowable contents, i.e., liquid, accumulate between an interior surface of the cover 12 and the disk 50, the drain hole ensures the drainage of such contents into the container.

Referring to FIG. 1, the disk 50 and the cover 12 are cooperatively dimensioned such that the disk 50 can be positioned within an interior portion of the cover 12 to define an "assembled position." Referring to FIG. 3, in the assembled position, the disk 50 is rotatably supported by at least one support ledge 102 which is formed by the support member 34 extending radially inward as explained above. Specifically, a portion of the edge 51 of the disk 50 rotatably engages the support ledge 102. The disk 50 can be further rotatably supported by the interior edge 104 of the recessed portion 40. Although the cover 12 is shown in one preferred embodiment as having three support members 34 and three corresponding support ledges 102, the number and configuration of the members 34 and the ledges 102 can vary with the design parameters.

In the assembled position, the disk 50 is positioned proximate the cover 12 such that at least a portion of the post 54 is received by and extends through the slot 30. Described in a different manner, the disk 50 is positioned beneath the cover 12 such that the center portion 36 of the cover 12 is proximate the center portion 62 of the disk 50.

In the assembled position, the disk 50 is movable between a first position P1 and a second position P2. In the first position P1, as shown in FIG. 1, the projection 52 is received by the drink opening 28 such that the opening 28 is sealed and the lid 10 is closed. When the opening 28 is sealed, the edge 29 of the opening 28 is in frictional engagement with the projection 52. The top portion 70 of the projection 52 can extend past the edge 29 of the drink opening 28. This seal prevents the flow of the flowable substance in the container through the opening 28, enabling the container and lid 10 to be moved without risking spillage. Also, in the first position P1, the recessed portion 84 of the disk 50 is engaged with the recessed portion 40 of the cover 12. In addition, in the first position P1, the aperture 78 is misaligned or offset from the opening 28. Alternatively, the projection 52 and the opening 28 are in a snap fit engagement wherein each have sufficient structure to enable the snap fit engagement. Other cooperating structures can also be utilized.

In an alternate configuration of the disk 50, the projection 52 is omitted and the disk 50 has a generally planar surface (not shown). In the first position P1, the planar surface of the disk 50 is aligned with the opening 28 in a surface-to-surface engagement such that the opening 28 is sealed.

In the second position P2, a user engages the post 54 to rotate the disk 50 wherein the aperture 78 is aligned with the drink opening 28 to form a passageway between the disk 50 and the cover 12 wherein the lid 10 is open. The passageway permits the passage or flow of the flowable substance held by the container through the lid 10. When the lid 10 is in the second position P2, at least a portion of the edge 80 of the aperture 78 is aligned with at least a portion of the edge 29 of the drink opening 28. Also, in the second position P2, the recessed portion 84 of the disk 50 is misaligned or offset from with the recessed portion 40 of the cover 12. In addition, in the second position P2, the projection 52 is misaligned or offset from the opening 28. When the aperture 78 is partially aligned with the drink opening 28, the passageway remains but its dimensions are reduced. When the aperture 78 is completely misaligned with the drink opening 28, the passageway is eliminated. When the aperture 78 is completely misaligned with the drink opening 28 and the projection 52 is completely received in the opening 28, the opening 28 is sealed and the lid 10 is in the first position P1.

When the disk 50 is moved between the first position P1 and the second position P2, a portion of the edge 51 of the disk 50 remains in rotatable engagement with the support ledge 102. Accordingly, the support ledge 102 provides support to the disk 50 such that the disk 50 remains in the assembled position during movement between the first and second positions, P1, P2. When the cover 12 includes a plurality of support ledges 102, a greater portion of the edge 51 of the disk 50 remains in rotatable engagement with the support ledges 102. The edge 104 of the recessed portion 40 provides additional support for the disk 50 as it is moved between the first and second positions P1, P2.

A user can move the disk 50 between the first position P1 and the second position P2 by grasping and actuating or manipulating the post 54 between the first end 30*a* of the slot 30 and the second end 30*b* of the slot 30. Referring to FIG. 1, when the post 54 is proximate the first end 30*a*, the disk 50 is in the first position P1. Conversely, when the post 54 is proximate the second end 30*b*, the disk 50 is in the second position P2. The post 54 can be located in a number of positions between the first and second ends 30*a*, 30*b* and as a result, the projection 52 can be misaligned with the opening 28 to varying degrees.

The disk 50 can be rotated or moved a varying amount depending upon the numerous design parameters of the lid 10, including but not limited to the configuration and dimensions of the post 54 and the slot 30. Thus, the disk 50 assumes a number of positions and those positions depend upon the location of the post 54 relative to the slot 30. The movement of the disk 50 and the post 54 is ultimately constrained by the first and second ends 30*a*, 30*b* of the slot 30.

The lid 10 is adapted to permit a user to move the post 54 between the first and second positions P1, P2 with only one hand. This means that a user can hold the container and manipulate the post 54 with the same hand. This increases the flexibility and the commercial value of the lid 10.

As explained above, the disk 50 can have two separate apertures 78, wherein the apertures 78 are positioned about the projection 52. In this configuration, the disk 50 can be rotated in either a clockwise or counter-clockwise direction to move the disk 50 between the first position P1 and the second position P2. For example, rotating the disk 50 in the clockwise direction brings one aperture 78 into alignment with the opening 28, while rotating the disk in the counter-clockwise direction brings the other aperture 78 into alignment with the opening 28. This feature further increases the flexibility and the commercial value of the lid 10. In such configuration, the length of the slot 30 is increased to allow for counterclockwise rotation of the disk 50 such that both apertures 78 can be aligned with the opening 28.

The lid 10 is adapted to be used without the disk 50. This means that the cover 12 is connected to a container but the disk 50 is omitted. In this configuration, there is no slot 30 and there is no structure to seal the opening 28 in the cover 12 and as a result, the flowable substance held by the container can pass through the lid 10. In this configuration, the recessed portion 40 remains positioned on both the top wall 14 and the side wall 16. However, the drink opening 28 can be positioned in either the top wall 14 or the side wall 16.

The opening 28 can be formed with a range of dimensions. At a minimum, the opening 28 should have dimensions sufficient to permit the passage of the flowable substance held by the container and receive the projection 52. The slot 30 can be formed with a range of dimensions. At a minimum, the slot 30 should have dimensions sufficient to receive and permit the movement of the post 54.

The opening 28 can be located at various positions along the top wall 14 depending upon design parameters. Similarly, the slot 30 can be located at various positions along the top wall 12. The opening 28 and the slot 30 are spaced a distance apart. Preferably, the opening 28 and the slot 30 are opposed on the top wall 12, meaning that they are positioned approximately 180 degrees apart. Alternatively, the post 54 is located on the sidewall 59 of the disk 50, and the slot 30 is cooperatively located on the sidewall 16 of the cover 12. In this configuration, a user moves the lid 10 between the first and second positions P1, P2 by engaging the post 54 that extends through the slot 30 positioned on the side wall 16 of the cover 12.

Although shown as having a generally circular shape, the lid 10, including the mounting portion 22, the flange 24 and the skirt 26, can have numerous configurations. For example, the lid 10 could have a rectangular, square, or oval shape. To ensure a leak-proof seal with the container, the shape of the mounting portion 22 should match the shape of the upper edge of the container so a cooperative sealing engagement can be achieved.

Alternatively, the mounting portion 22 could have a shape similar to the upper edge of the container, yet dissimilar from the shape of the side wall 16 and the top wall 14. For example, the mounting portion 22 could have an annular shape consistent with the container shape and the walls 14, 16 could have a non-annular shape.

Unlike prior art designs, the dimensions and the configuration of the opening 28 are not affected by the engagement and disengagement of the projection 52 as the disk 50 is moved between the first and second positions P1, P2. This attribute allows a user to repeatedly move the disk 50 between the first position and second position. Accordingly, the structural integrity and the durability of the lid 10 are increased.

The well 90 is adapted to aid in the storage and/or stacking of the disk 50 prior to the disk 50 and cover 12 being placed in the assembled position. Specifically, the well 90 is adapted to ensure that multiple disks 50 remain stacked in a stable vertical configuration prior to assembly of the lid 10. A portion of the well 90 of a first disk 50 engages a portion of well 90 of an adjacent second disk 50 positioned below the first disk 50. Accordingly, the well 90 should have a depth or length sufficient to permit it to engage a portion of the well 90 of the second disk 50. In an alternative configuration, the well 90 can be randomly placed wherein the well 90 of the first disk would rest on the top wall 56 of the second disk 50.

The well 90 is further adapted to aid in the storage and/or stacking of the assembled lid 10. Specifically, the well 90 is adapted to ensure that multiple lids 10 remain stacked in a stable vertical configuration. A portion of the well 90 of a first lid 10 engages a portion of an adjacent cover 12 of a second lid 10 positioned below the first lid 10. Accordingly, the well 90 should have a depth or length sufficient to permit it to engage a portion of the cover 12. The engagement of the well 90 with a portion of the cover 12 stabilizes the first and second lids 10 in their vertical position. The engagement of the well 90 with a portion of the cover 12 prevents the first and second lids 10 from becoming destabilized and/or misaligned.

The lid 10 can be formed by a variety of manufacturing processes, such as injection molding or a thermoforming operation, preferably vacuum forming and/or pressure forming. The cover 12 is preferably formed from plastic, however, other lightweight materials can be used to form the cover 12. After the manufacturing process has been completed, the drink opening 28 and the slot 30 may be formed in the cover 12 with a punch and die.

Preferably, the disk 50 is formed from the same material used to form the cover 12. However, the disk 50 can be formed from other lightweight materials. After the manufacturing process has been completed, the aperture 78 may be formed in the disk 50 with a punch and die.

The lid 10 can include a color-based system for indicating the status of the lid 10. Under the color-based system, a portion of the lid 10 would display a first color, e.g., red, when the lid 10 is closed in the first position P1. Similarly, a portion of the lid 10 would display a second color, e.g., green, when the lid 10 is open in the second position P2. The first and second colors would be displayed in a visible portion of the lid 10 such that a user of the lid 10 could readily ascertain the status of the lid 10. Referring to FIGS. 1 and 4, the first color is positioned on the disk 50 to the right of the post 54 and the second color is positioned on the disk 50 to the left of the post 54. Accordingly, when the lid 10 is in the closed position P1 shown in FIG. 1, the first color is visible through the slot 30. Conversely, when the lid 10 is in the open position P2, the second color is visible through the slot 30. In this manner, a user can verify the status of the lid 10 by simply looking at the color indicator displayed through the slot 30. As a result, the utility and marketability of the lid 10 is increased.

In an alternate color-based system configuration, the first color is positioned on the projection 52 wherein it is visible when the lid 10 is in the closed position P1. The second color is positioned on the edge 80 about the aperture 78 wherein it is visible when the lid 10 is in the open position P2. In this manner, a user can verify the status of the lid 10 by simply looking at the color indicator displayed in the opening 28.

Figure 5:
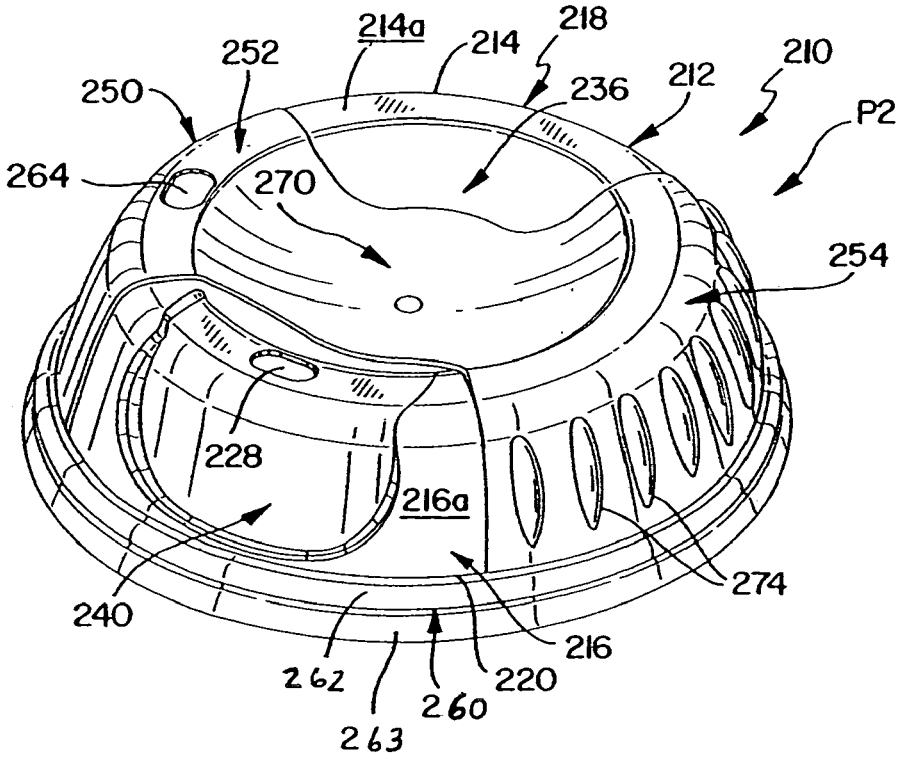
FIG. 5 is a perspective view of an alternate embodiment of a lid of the present invention, showing the lid in an open position.

FIGS. 5–8 disclose another preferred embodiment of the lid of the present invention. As shown in FIG. 5, the reclosable lid 210 generally includes a first piece or cover 212, and a movable second piece or overlay 250. FIG. 5 shows the lid 210 in the open position wherein the flowable substance can flow or pass through the lid 210 via opening 228.

Figure 6:
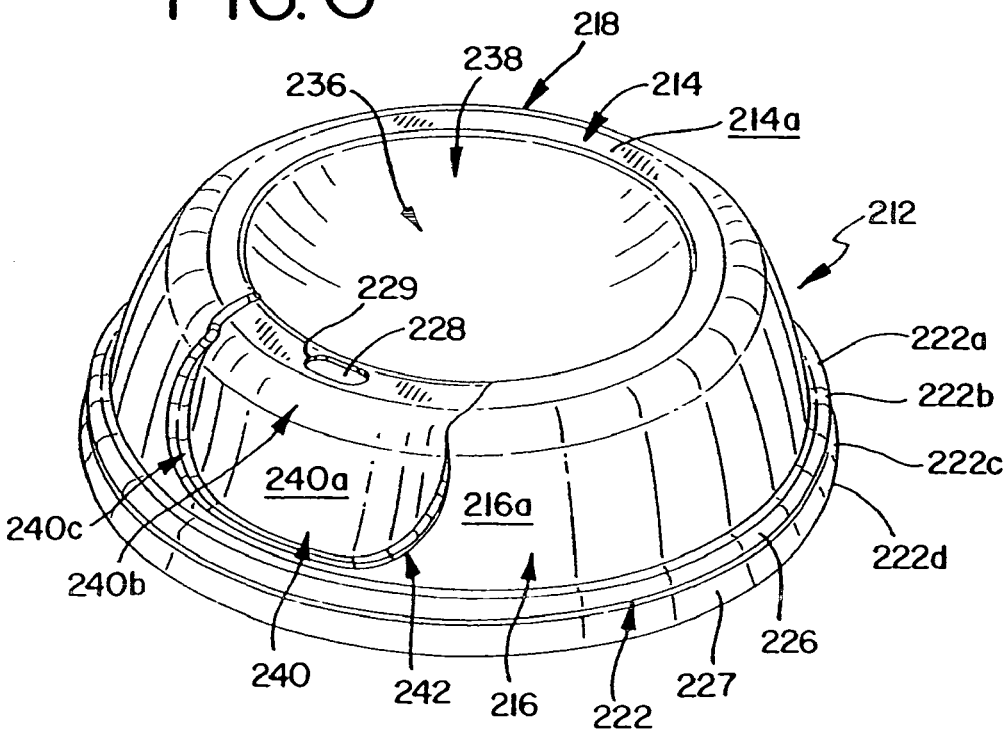
FIG. 6 is a perspective view of a cover of the lid of FIG.5.

Referring to FIGS. 5 and 6, the cover 212 is adapted to span the opening in the upper portion of the container (not shown) that is generally defined by an upper rim or edge of the container. The cover 212 has an annular top wall 214 and a side wall 216 depending from an outer or peripheral edge 218 of the top wall 214. Although the top wall 214 is shown as having a generally flat upper surface 214*a*, the upper surface 214*a* can be curved or angled. The side wall 216 has a side wall surface 216*a* and a lower edge 220. The side wall surface 216*a* can be curved, angled, or generally flat. The overall shape of the cover 212 is generally frustaconical, however, the cover 212 can have a number of other configurations.

A mounting portion 222 depends from the lower edge 220 of the side wall 218. The mounting portion 222 includes a generally annular flange 224 and a generally annular skirt 226. The mounting portion 222 is adapted for connecting the lid 210 to the container in a manner that seals the lid 210 on the container. Thus, the mounting portion 222 prevents leakage of the container contents between the lid 210 and the container when the lid 210 is positioned on the container. In a preferred embodiment, the mounting portion 222 is integral with the side wall 16.

An aperture or drink opening 228 is located preferably in the top wall 216. Alternatively, the drink opening 228 is located in the side wall 216. The opening 228 is adapted to permit the passage or flow of the flowable contents held by the container through the cover 212. The opening 228 has an edge 229 that defines the shape of the opening 228. Although shown in FIG. 6 as having an obround shape, the opening 228 can have a variety of shapes, including but not limited to circular, square, or rectangular.

The opening 228 can be formed with a range of dimensions. At a minimum, the opening 228 should have dimensions sufficient to permit the passage of the flowable substance held by the container. The opening 228 can be located at various positions along the top wall 214 depending upon design parameters.

As shown in FIG. 6, a center portion 236 is positioned radially inward from an inner edge 238 of the top wall 214. Preferably, the center portion 236 is recessed such that the center portion 236 has a curvilinear configuration when viewed in cross-section. Described in a different manner, the center portion 236 has a concave shape when the portion 236 is viewed from a point above the lid 210. The degree of recess or curvature of the center portion 236 can vary with the design parameters of the lid 210.

Referring to FIGS. 5 and 6, the side wall 216 has a recessed portion 240 that is adapted to receive a lip of a person drinking from the container. An edge 242 of recessed portion 240 defines the configuration of the portion 240. The recessed portion 240 and the recessed surface 240*a* are positioned radially inward from the side wall surface 216*a*. Although the recessed portion 240 is shown positioned on both the top wall 214 and the side wall 216, the recessed portion 240 can be limited to either the top wall 214 or the side wall 216. The shape and configuration of the recessed portion 240 can be varied to conform to numerous design parameters. Similarly, the degree of recess of the portion 240 can vary. Preferably, the recessed portion 240 is positioned about the drink opening 228. The top wall 214 and the side wall 216 cooperate to form a rounded edge 240*b* at the recessed portion 240.

Figure 7:
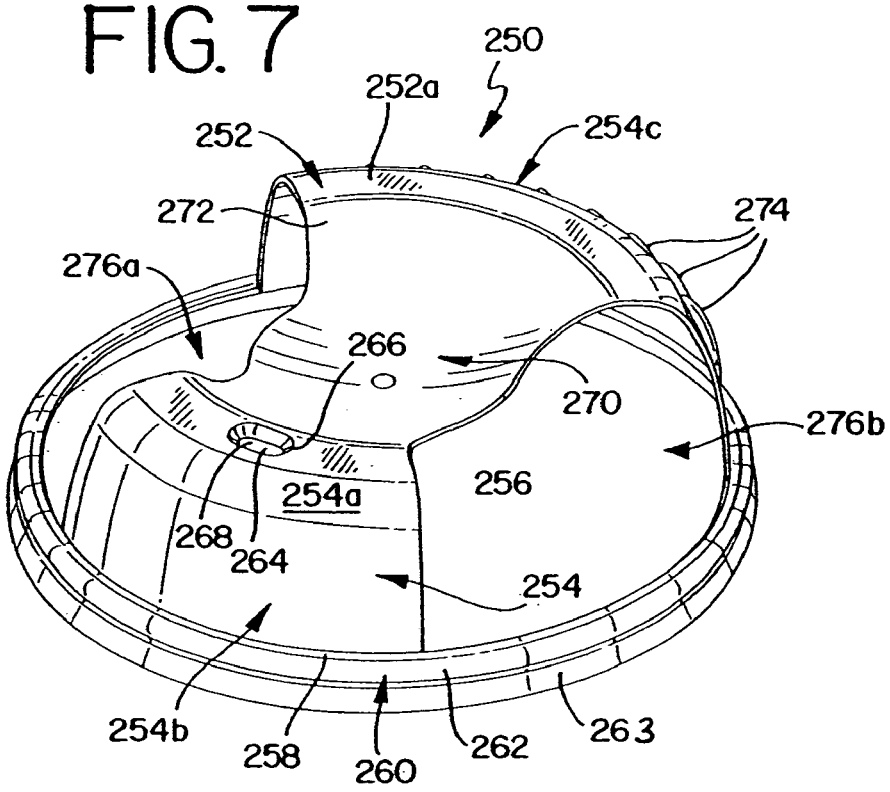
FIG. 7 is a perspective view of an overlay of the lid of FIG. 5.

As shown in FIGS. 5 and 7, the overlay 250 is a discontinuous structure adapted to be positioned about the cover 212. The overlay has a top wall 252 and a side wall 254 depending from an outer or peripheral edge 256 of the top wall 252. Although the top wall 252 is shown as having a generally flat upper surface 252*a*, the upper surface 252*a* can be curved or angled. The side wall 254 has a side wall surface 254*a* and a lower edge 258. The side wall surface 254*a* can be curved, angled or generally flat.

A mounting portion 260 depends from the lower edge 258 of the side wall 254. The mounting portion 260 includes a generally annular flange 262 and a generally annular skirt 263. The mounting portion 260 is adapted for rotatably connecting the overlay 250 to the mounting portion 222 of the cover 212 such that the overlay 250 and the cover 212 are in rotatable engagement. The mounting portions 222, 260 are cooperatively dimensioned such that the overlay 250 can be positioned about the cover 212 wherein the overlay 250 can be rotatably moved with respect to the cover 212. The mounting portions 222, 260 have a generally annular configuration. Alternately, the mounting portions 222, 260 could have a configuration with angular or linear segments.

Preferably the mounting portions 222, 260 have a continuous configuration, as shown in FIGS. 5–8. Alternatively, the mounting portions 222,260 have a discontinuous configuration, meaning that the portions 222, 260 have material removed that results in a notched configuration.

As shown in FIG. 7, the overlay 250 has a projection 264 that is located preferably in the top wall 252. Alternatively, when the drink opening 228 is positioned in the side wall 216 of the cover 212, the projection 264 is cooperatively positioned in the side wall 254 of the overlay 250. The projection 264 depends from a lower or inner surface (not shown) of the top wall 252. The projection 264 has a peripheral edge 266 that defines the shape of the projection 264. Preferably, the projection 264 is cooperatively dimensioned with the drink opening 228 such that at least a portion of the projection 264 is adapted to be received by or positioned in the opening 228. When the projection 264 is completely received in the opening 228, the opening 228 is sealed and the lid 210 is in the closed position shown in FIG. 8. In the closed position, a bottom wall 268 of the projection 264 extends past the top wall surface 214*a*.

As further shown in FIG. 7, a center portion 270 is positioned radially inward from an inner edge 272 of the top wall 252. Preferably, the center portion 270 is recessed such that the center portion 270 has a curvilinear configuration when viewed in cross-section. Described in a different manner, the center portion 270 has a concave shape when the portion 270 is viewed from a point above the lid 210. The degree of recess or curvature of the center portion 270 can vary with the design parameters of the lid 210. Alternatively, the center portion 270 is in planar alignment with the top wall 252. In this configuration, the center portion 270 is not recessed.

The overlay 250 has at least one gripping element 274 positioned on a portion of the side wall 254. The gripping element 274 is adapted to facilitate rotational movement of the overlay 250. Accordingly, a user engages the element 274 to aid in the rotation of the overlay 250. Although shown as having a generally elongated configuration, the element 274 can have a wide range of configurations and dimensions. In addition, the gripping element 274 can be positioned on the side wall 254, the top wall 252 or on a portion of both the side wall 254 and the top wall 252. Alternatively, the gripping element 274 is positioned on a portion of the mounting portion 260. The gripping element 274 can be integral to the overlay 250 or it can be a separate element fastened to a portion of the overlay 250. For example, the gripping portion can be a plastic or rubber element fastened to the overlay 250.

The overlay 250 can have alternate structures for facilitating movement of the overlay 250. For example, the overlay 250 could have a post or a ring extending from a portion of the overlay 250, each adapted for a user to engage and rotate the overlay 250.

Figure 8:
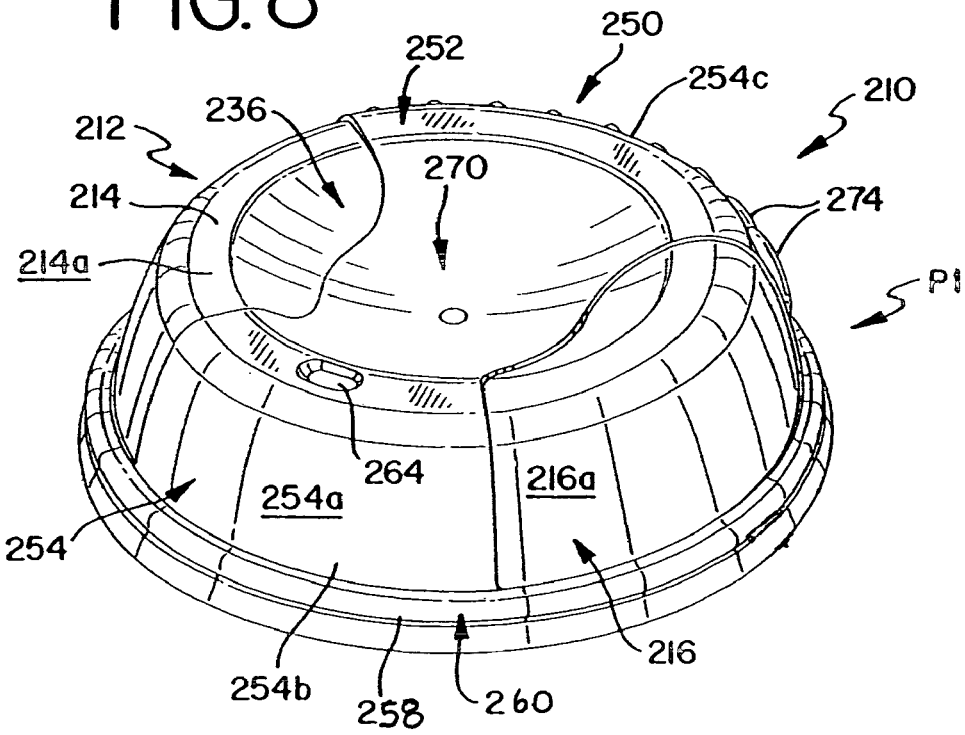
FIG. 8 is a perspective view of the lid of FIG. 5, showing the lid in a closed position.

As shown in FIGS. 5, 7 and 8, and as explained above, the overlay 250 has a discontinuous structure, meaning that neither the top wall 252 nor the side wall 254 are continuous along the circumference of the cover 250. As a result, the overlay has a first side wall portion 254*b* and a second side wall portion 254*c*. When the projection 264 is located in a portion of the top wall 252, the projection 264 is positioned proximate either of the side wall portion 254*b* or the second side wall portion 254*c*. Preferably, the gripping element 274 is positioned on the other of the wall portion 254*b* or the second side wall portion 254*c*. Alternatively, the gripping element 274 is positioned on the side wall portion 254*b*, 254*c* proximate the projection 264.

Due to its discontinuous configuration, the overlay 250 has an aperture 276. In one preferred embodiment, the overlay 250 has two aperture 276 wherein the portion of the overlay 250 above the mounting portion 262 has a generally hour-glass shape. The configuration and dimensions of the aperture 276 can vary greatly with the design parameters of the lid 210. Referring to FIG. 7, the overlay 250 has two separate apertures 276*a*, 276*b*. Each of the apertures 276*a*, *b* span a portion of the side wall 254, the top wall 252 and the center portion 270. Alternatively, the apertures 276*a*, 276*b* span only a portion of the side wall 254 and the top wall 252.

As shown in FIG. 5, the aperture 276 is adapted to permit the passage or flow of the flowable contents held by the container through the opening 228 when the aperture is generally positioned about the opening 228. Described in another manner, when the aperture 276 is aligned with the opening 228, the flowable contents can pass through the opening 228. Therefore, the aperture 276 should have a minimum configuration sufficient to permit the passage of the flowable contents through the aperture 228.

The cover 212 and the overlay 250 each have a generally thin-wall construction. However, the wall thickness of the cover 212 and the overlay 250 can vary depending upon the design parameters, including the structural integrity of the lid 210.

Referring to FIGS. 5 and 8, the overlay 250 and the cover 212 are cooperatively dimensioned such that the overlay 250 can be positioned on the cover 212 to define an "assembled position." In the assembled position, the overlay 250 is rotatably supported by the engagement of its mounting portion 260 and the mounting portion 222 of the cover 212. Specifically, a lower surface of the mounting portion 260 engages an upper surface of the mounting portion 222. Accordingly, the mounting portion 260 and the mounting portion 222 are cooperatively dimensioned such that the overlay 250 can be rotated with respect to the cover 212, where the cover 212 is generally fixed to the container.

In addition, the overlay 250 can be rotatably supported by the engagement of its center portion 270 and the center portion 236 of the cover 212. Specifically, a lower surface of the center portion 270 engages an upper surface of the center portion 236. Accordingly, the center portion 270 is cooperatively dimensioned with the center portion 236 of the cover 212. Alternatively, the lid 210 can be configured to have a clearance between the center portions 236, 270 such that the center portions 236, 270 are not in engagement. In this configuration, the overlay 250 rotatably engages the cover 212 by the engagement of the mounting portions 222, 260.

Alternatively, the overlay 250 can be rotatably supported by the engagement of its top wall 252 with the top wall 214 of the cover 212. Accordingly, the top wall 252 is cooperatively dimensioned with the top wall 214 of the cover 212. In another alternative, the overlay 250 can be rotatably supported by the engagement of its side wall 254 with the side wall 216 of the cover 212. Accordingly, the side wall 254 is cooperatively dimensioned with the side wall 216 of the cover 212.

In the assembled position, the overlay 250 is movable between a first position P1 and a second position P2. In the first position P1, shown in FIG. 8, the projection 264 is received by the drink opening 228 such that the opening 228 is sealed wherein the lid 210 is closed. When the opening 228 is sealed, the edge 229 of the opening 228 is in frictional engagement with the projection 264. A bottom portion (not shown) of the projection 264 can extend past the edge 229 of the drink opening 228. This seal prevents the flow of the flowable substance in the container through the opening 228, enabling the container and lid 210 to be moved without risking spillage. Also, in the first position P1, the aperture 276 is misaligned or offset from the opening 228. Alternatively, the projection 264 and the opening 228 are in a snap fit engagement wherein each have sufficient structure to enable the snap fit engagement. Other cooperating sealing structures can also be utilized.

In the second position P2, shown in FIG. 5, a user rotates the overlay 250 wherein the aperture 276 is aligned with the drink opening 228 to form a passageway between the overlay 250 and the cover 212. In the second position P2, the lid 210 is open. The passageway permits the passage or flow of the flowable substance held by the container through the lid 210. When the lid 210 is in the second position P2, at least a portion of the aperture 276 is aligned with at least a portion of the edge 229 of the drink opening 228. Also, in the second position P2, at least a portion of the recessed portion 240 of the cover 212 is aligned with the aperture 276. In addition, in the second position P2, the 30 projection 264 is misaligned or offset from the opening 228. When the aperture 276 is partially aligned with the drink opening 228, the passageway remains but its dimensions are reduced.

When the overlay 250 is moved between the first position P1 and the second position P2, the mounting portion 260 of the overlay 250 remains in rotatable engagement with at the mounting portion 222 of the cover 212. Accordingly, the mounting portions 222, 260 provide support to the overlay 250 such that the overlay 250 remains in the assembled position during movement between the first and second positions, P1, P2.

When the overlay 250 is moved between the first position P1 and the second position P2, the center portion 270 of the overlay 250 remains in rotatable engagement with at the center portion 236 of the cover 212. Accordingly, the center portions 236, 270 provide an additional amount of support to the overlay 250 such that the overlay 250 remains in the assembled position during movement between the first and second positions, P1, P2.

A user can move the overlay 250 between the first position P1 and the second position P2 by grasping and manipulating a portion of the overlay 250, for example, the side wall 254, the top wall 252 or the mounting portion 260. Alternatively, when so configured, the user can move the overlay 250 between the first and second positions P1, P2 by engaging the gripping element 274.

The overlay 250 can be rotated or moved a varying amount depending upon the numerous design parameters of the lid 210, including but not limited to the configuration and dimensions of the side wall 254, the mounting portion 260, the projection 264 and the aperture 270. Thus, the overlay 250 can assume a number of positions with respect to the cover 212. The lid 210 is adapted to permit a user to move the overlay 250 between the first and second positions P1, P2 with only one hand. This means that a user can hold the container and manipulate the overlay 250 with the same hand. This increases the flexibility and the commercial value of the lid 210. As shown in FIG. 5, 7 and 8, the overlay 250 has two separate apertures 276 which permit the overlay 250 to be rotated in either a clockwise or counter-clockwise direction to move the overlay 250 between the first position P1 and the second position P2. This feature further increases the flexibility and the commercial value of the lid 210.

The lid 210 is adapted to be used without the overlay 250. This means that the cover 212 is connected to a container but the overlay 250 is omitted. In this configuration, there is no structure to seal the opening 228 in the cover 212 and as a result, the flowable substance held by the container can pass through the lid 210. In this configuration, the recessed portion 240 remains positioned on both the top wall 214 and the side wall 216. However, the drink opening 228 can be positioned in either the top wall 214 or the side wall 216.

Although shown as having a generally circular shape, the lid 210, including the mounting portions 222, 260, can have numerous configurations. For example, the lid 210 could have a rectangular, square, or oval shape. To ensure a leak-proof seal with the container, the shape of the mounting portion 222, 260 should match the shape of the upper edge of the container so a cooperative sealing engagement can be achieved.

Alternatively, the mounting portions 222, 260 could have a shape similar to the upper edge of the container, yet dissimilar from the shape of the side walls 216, 254 and the top walls 214, 252. For example, the mounting portions 222, 260 could have an annular shape consistent with the container shape and the side walls 216, 254 and/or the top walls 214, 252 could have a non-annular shape.

Unlike prior art designs, the dimensions and the configuration of the opening 228 are not affected by the engagement and disengagement of the projection 264 as the overlay 250 is moved between the first and second positions P1, P2. This attribute allows a user to repeatedly move the overlay 250 between the first position P1 and the second position P2. Accordingly, the structural integrity and the durability of the lid 210 are increased.

The lid 210 can be formed by a variety of manufacturing processes, such as injection molding or a thermoforming operation, preferably vacuum forming and/or pressure forming. The cover 212 is preferably formed from plastic, however, other lightweight materials can be used to form the cover 212. After the manufacturing process has been completed, the drink opening 228 may be formed in the cover 212 with a punch and die. The aperture 276 could also be formed with a punch and die.

Preferably, the overlay 250 is formed from the same material used to form the cover 212. However, the overlay 250 can be formed from other lightweight materials.

The cover 212 can have at least one cover drain hole (not shown), preferably positioned in the center portion 236 near a lowermost portion of the center portion 236. When excess flowable contents, e.g., liquid, accumulate on the cover 212, the drain hole ensures the drainage of such contents into the container.

The overlay 250 can have an overlay drain hole (not shown), that is cooperatively dimensioned with the cover drain hole described above. The overlay drain hole is cooperatively positioned with the cover drain hole such that when the overlay 250 is rotated to the first position P1, the cover drain hole and the overlay drain hole align to form a passageway that ensures the drainage of accumulated container contents. Alternatively, the overlay drain hole is cooperatively positioned with the cover drain hole such that when the overlay 250 is rotated to the second position P2, the cover drain hole and the overlay drain hole align to form the passageway.

The cover 212 can have at least one cover vent hole (not shown), preferably in the center portion 236 or the side wall 216. Alternatively, the cover vent hole is positioned in a portion of the top wall 214 or a portion of the side wall 216. The cover vent hole is adapted to ensure the continuous flow of the container contents though the opening 228 while venting the container. Preferably, the cover vent hole is positioned such that the venting of the container occurs while the lid 210 is in the second position P2.

The overlay 250 can have an overlay vent hole (not shown), that is cooperatively dimensioned with the cover vent hole described above. The overlay vent hole is cooperatively positioned with the cover vent hole such that when the overlay 250 is rotated to the second position P2, the cover vent hole and the overlay vent hole align to form a passageway that ensures the venting of the container.

The drain holes and the vent holes described above can be formed with a punch and die after the lid 210 manufacturing process has been completed. Alternatively, a pointed tool may be used to form the drain holes and the vent holes.

In another preferred embodiment (not shown), the lid has at least one pin on either the overlay or the cover. In addition, the lid has at least one socket on the other of the overlay or the cover. The pin and the socket are cooperatively dimensioned such that when the pin is received by the socket, the overlay is in rotational engagement with the cover. Because the overlay and the cover are in rotational engagement, the lid can be rotated between the first and second positions P1, P2. The pin and socket are adapted to support the overlay when the lid is rotated between the first and second positions P1, P2.

The cover has a center portion that can be recessed. The overlay is a discontinuous structure that is adapted to be positioned about the cover. The overlay has at least one aperture that is alignable with an opening in the cover. Preferably, the pin depends from a lower surface of the overlay, and the socket depends from an upper surface of the cover. In this configuration, the socket is positioned in the center portion of the cover.

The overlay can include an annular mounting portion that engages a mounting portion of the cover. The overlay mounting portion supports the overlay during movement between the first and second positions. Alternatively, the overlay includes a mounting portion but it is segmented, meaning that it is not annular.

In another alternative, the annular mounting portion is omitted from the overlay. In this configuration, the pin and socket primarily support the overlay when the lid is rotated between the first and second positions P1, P2.

While specific embodiments have been illustrated and described, numerous modifications come to mind without significantly departing from the spirit of the invention and the scope of protection is only limited by the scope of the accompanying Claims.

What is claimed is:

1. A lid for a container holding a flowable substance, the lid comprising:

a cover having an annular top wall, a side wall depending from the annular top wall, the side wall having a mounting portion for removably connecting the lid to the container wherein the mounting portion defines the outermost and lowermost periphery of the cover, and the cover further having an opening in the annular top wall adapted to permit the passage of the flowable substance through the lid; and, an overlay having a top wall and a side wall depending from the top wall, the side wall having a mounting portion for connecting the overlay to the cover wherein the mounting portion defines the outer periphery of the overlay, the overlay further having a downwardly directed projection in the top wall and at least one aperture;

wherein the overlay and the cover are cooperatively dimensioned such that the overlay and the cover are in rotational engagement wherein the overlay is movable between a first position and a second position, wherein at least a portion of the projection is received in the opening in the first position and wherein the at least one aperture is aligned with the opening in the second position.

2. The lid of claim 1 wherein the projection and the opening are cooperatively dimensioned such that the projection seals the opening in the first position.

3. The lid of claim 1 wherein the at least one aperture is offset from the opening in the first position.

4. The lid of claim 1 wherein the movement of the overlay to the second position exposes at least a portion of the opening.

5. The lid of claim 1 wherein the at least one aperture and the opening are cooperatively dimensioned such that a passageway is formed in the second position, the passageway permitting the passage of the flowable substance through the lid.

6. The lid of claim 1 wherein the projection is offset from the opening in the second position.

7. The lid of claim 1 wherein the top wall of the cover has a recessed portion and the top wall of the overlay has a cooperatively dimensioned recessed portion such that the recessed portions are in rotational engagement during movement between the first and second positions.

8. The lid of claim 7 wherein the mounting portion of the cover and the mounting portion of the overlay are cooperatively dimensioned such that the recessed portions are in rotational engagement.

9. The lid of claim 1 wherein the top wall of the cover and the top wall of the overlay are cooperatively dimensioned such that the walls are in rotational engagement during movement between the first and second positions.

10. The lid of claim 1 wherein the top wall of the cover has a recessed lip portion, the opening positioned in the recessed lip portion.

11. The lid of claim 1 wherein the overlay has at least one gripping member on an outer surface of the overlay, the gripping member adapted to facilitate movement of the overlay between the first and second positions.

12. A lid for a container holding a flowable substance, the lid comprising:

a cover having a top wall with a recessed central portion extending downward from an inner periphery of the top wall, the top wall having an opening positioned adjacent an outer periphery of the top wall, the cover further having a side wall depending from the top wall, the cover having a mounting portion for removably connecting the lid to the container, wherein the side wall extends upward from the mounting portion to the top wall;

an overlay having a top wall with a recessed central portion, the top wall having a projection depending therefrom, the overlay further having a side wall depending from the top wall, the overlay having a mounting portion for rotatably connecting the overlay to the mounting portion of the cover, the overlay further having at least one aperture; and, wherein the overlay is movable between a first position wherein the projection is received by the opening, and a second position wherein the at least one aperture is aligned with the opening.

13. The lid of claim 12 wherein the projection and the opening are cooperatively dimensioned such that the projection seals the opening in the first position.

14. The lid of claim 12 wherein the recessed portion of the cover and the recessed portion of the overlay are cooperatively dimensioned such that the recessed portions are in rotational engagement as the overlay is moved between the first and second positions.

15. The lid of claim 14 wherein the top wall of the cover and the top wall of the overlay are cooperatively dimensioned such that the top walls are in rotational engagement as the overlay is moved between the first and second positions.

16. The lid of claim 12 wherein the mounting portion of the overlay and the mounting portion of the cover are in rotational engagement as the overlay is moved between the first and second positions.

17. A removable lid for a container holding a flowable substance, the lid comprising:

a cover having a top wall with an opening, the cover further having a side wall depending from the top wall, the side wall having a mounting portion for removably connecting the lid to the container, the mounting portion having a circumferential flange configured to removably contact the container, wherein the flange defines the outermost periphery of the cover;

an overlay having a mounting portion for rotatably connecting the overlay to the mounting portion of the cover, the overlay having a band extending between generally opposed segments of the mounting portion, the overlay having a first aperture defined between a first edge of the band and the mounting portion and a second aperture defined between a second edge of the band and the mounting portion; and, wherein the overlay is movable between a first position wherein a portion of the band obstructs the opening, and a second position wherein one of either the first aperture or the second aperture is aligned with the opening.

18. The lid of claim 17 wherein the band has a top wall with a projection depending therefrom, wherein the projection is received by the opening in the first position.

19. The lid of claim 18 wherein the top wall of the cover has a recessed central portion and the band has recessed central portion, wherein the recessed central portions are in engagement during movement between the first and second positions.

20. The lid of claim 18 wherein the first and second apertures are misaligned with the opening of the cover in the first position.

21. A removable lid for a container holding a flowable substance, the lid comprising:

a cover having a mounting portion for removably connecting the lid to the container wherein the mounting portion defines an outermost periphery of the cover, the cover further having a side wall extending upward from the mounting portion to a top wall, the top wall having an opening positioned proximate an outer periphery of the top wall; and, an overlay having a mounting portion that engages the mounting portion of the cover for removable connection of the overlay to the cover wherein the mounting portion defines the outermost periphery of the overlay, the overlay further having a side wall extending upward from the mounting portion to a top wall, the overlay further having at least one aperture;

wherein the overlay is movable between a first position wherein the opening is obstructed by the overlay, and a second position wherein the at least one aperture is aligned with the opening.

22. The lid of claim 21 wherein the top wall of the cover has an annular configuration and the top wall of the overlay has an annular configuration, wherein the top walls of the cover and the overlay are in engagement during movement between the first and second positions.

23. The lid of claim 22 wherein the cover has a recessed central portion depending from an inner periphery of the top wall and the overlay has a recessed central portion depending from an inner periphery of the top wall, wherein the recessed central portions of the cover and the overlay are in engagement during movement between the first and second positions.

24. The lid of claim 23, wherein the overlay has a projection that is received by the opening in the first position.

25. The lid of claim 24, wherein the projection depends from a top wall of the overlay.

* * * * *